US009737156B2

(12) United States Patent
Twohy

(10) Patent No.: US 9,737,156 B2
(45) Date of Patent: Aug. 22, 2017

(54) ZONE COOLING IN A REFRIGERATED MERCHANDISER

(71) Applicant: Hussmann Corporation, Bridgeton, MO (US)

(72) Inventor: Raymond P. Twohy, Saint Peters, MO (US)

(73) Assignee: Hussmann Corporation, Bridgeton, MO (US)

( * ) Notice: Subject to any disclaimer, the term of this patent is extended or adjusted under 35 U.S.C. 154(b) by 116 days.

(21) Appl. No.: 14/138,630

(22) Filed: Dec. 23, 2013

(65) Prior Publication Data

US 2015/0173527 A1 Jun. 25, 2015

(51) Int. Cl.

| | |
|---|---|
| ***A47F 3/04*** | (2006.01) |
| ***F25D 25/02*** | (2006.01) |
| ***F25B 21/02*** | (2006.01) |

(52) U.S. Cl.

CPC ..... *A47F 3/0482* (2013.01); *A47F 3/0447* (2013.01); *A47F 3/0491* (2013.01); *F25B 21/02* (2013.01); *F25D 25/028* (2013.01); *A47F 2003/046* (2013.01)

(58) Field of Classification Search

CPC .... A47F 3/0482; A47F 3/0447; A47F 3/0491; A47F 2003/046; F25D 25/028; F25D 2317/0665; F25D 23/025

USPC ..... 62/251

See application file for complete search history.

(56) References Cited

U.S. PATENT DOCUMENTS

| | | | | |
|---|---|---|---|---|
| 3,063,252 A | | 11/1962 | Lamb | |
| 3,168,818 A | | 2/1965 | Weber | |
| 3,369,375 A | * | 2/1968 | Gerweck | A47F 3/0447 62/256 |
| 3,696,630 A | | 10/1972 | Bressickello | |

(Continued)

FOREIGN PATENT DOCUMENTS

| | | |
|---|---|---|
| CN | 2416816 | 1/2001 |
| GB | 2231947 | 11/1990 |

(Continued)

OTHER PUBLICATIONS

Partial European Search Report for Application No. 14200141.1 dated Jun. 15, 2015 (5 pages).

(Continued)

*Primary Examiner* — Steve Tanenbaum

(74) *Attorney, Agent, or Firm* — Michael Best & Friedrich LLP

(57) ABSTRACT

A refrigerated merchandiser including a case that defines a product display area and an access opening. The case has an air inlet and an air outlet, and a passageway fluidly connects the air inlet with the air outlet to direct a refrigerated airflow across the customer access opening in the form of an air curtain. The merchandiser also includes shelves that are coupled to the case. Each shelf includes an inlet, an outlet, a fan unit disposed in the shelf, and a heat exchanger. The fan unit is in communication with the passageway to draw air through the inlet to direct a portion of the airflow through the shelf toward the outlet. The heat exchanger is disposed in the shelf to cool the airflow in the shelf to provide independent zone cooling to a predetermined region of the product display area.

18 Claims, 4 Drawing Sheets

(56) References Cited

U.S. PATENT DOCUMENTS

| | | | | |
|---|---|---|---|---|
| 5,357,767 | A * | 10/1994 | Roberts | A47F 3/0447 454/193 |
| 6,112,546 | A | 9/2000 | Kim | |
| 6,185,951 | B1 * | 2/2001 | Lane | A47F 3/0413 62/246 |
| 6,370,882 | B1 * | 4/2002 | Adamski | F25B 21/04 62/3.6 |
| 6,379,240 | B2 | 4/2002 | Livchak et al. | |
| 6,519,962 | B1 | 2/2003 | Schuetter | |
| 6,701,735 | B1 * | 3/2004 | Daddis, Jr. | A47F 3/0447 454/193 |
| 6,742,344 | B2 | 6/2004 | Vormedal | |
| 6,886,359 | B2 * | 5/2005 | Yamazaki | A47F 3/0443 454/193 |
| 6,971,247 | B2 | 12/2005 | Yamazaki et al. | |
| 7,137,438 | B2 | 11/2006 | Nomura et al. | |
| 7,451,607 | B2 | 11/2008 | Behr | |
| 2004/0069002 | A1 | 4/2004 | Chuang et al. | |
| 2006/0168978 | A1 | 8/2006 | Suda et al. | |
| 2008/0148751 | A1 | 6/2008 | Swofford | |
| 2009/0205351 | A1 | 8/2009 | Fung | |
| 2010/0024446 | A1 | 2/2010 | Rohrer et al. | |

FOREIGN PATENT DOCUMENTS

| | | |
|---|---|---|
| JP | 5133671 | 5/1993 |
| JP | 6026753 | 2/1994 |
| JP | 6123544 | 5/1994 |
| WO | 2007036736 | 4/2007 |
| WO | 2011121284 | 10/2011 |

OTHER PUBLICATIONS

Australian Patent Examination Report No. 1 for Application No. 2014280892 dated Nov. 20, 2015 (4 pages).

* cited by examiner

ZONE COOLING IN A REFRIGERATED MERCHANDISER

BACKGROUND

The present invention relates to a refrigerated merchandiser, and more particularly, to a refrigerated merchandiser that includes zone cooling areas within a product display area.

Refrigerated merchandisers generally include a case defining a product display area for supporting and displaying food products to be visible and accessible through an opening in the front of the case. Refrigerated merchandisers are generally used in retail food store applications such as grocery or convenient stores or other locations where food product is displayed in a refrigerated condition. Some refrigerated merchandisers include doors to enclose the product display area of the case and reduce the amount of cold air released into the surrounding environment. The doors typically include one or more glass panels that allow a consumer to view the food products stored inside the case. Other merchandisers do not have doors, but utilize one or more air curtains directed across the product display area to separate the refrigerated environment of the product display area from the ambient environment surrounding the merchandiser.

Refrigerated merchandisers also typically include one or more shelves that are used to support and display the food product. The shelves extend generally horizontally from a rear wall of the refrigerated merchandiser, and are stacked vertically relative to one another within the product display area.

SUMMARY

In one construction, the invention provides a refrigerated merchandiser a case defining a product display area and a customer access opening. The case has an air inlet and an air outlet in communication with the product display area, and a passageway fluidly connects the air inlet with the air outlet to direct a refrigerated airflow through the air outlet across at least a portion of the customer access opening in the form of an air curtain. The merchandiser also includes a plurality of shelves coupled to the case within the product display area to support product. Each shelf includes an inlet disposed adjacent a rear of the shelf, an outlet disposed adjacent a front of the shelf, a fan unit disposed in the shelf, and a heat exchanger. The fan unit is in communication with the passageway to draw air through the inlet to direct a portion of the airflow through the shelf toward the outlet. The heat exchanger is disposed in the shelf to cool the airflow in the shelf to provide independent zone cooling to a predetermined region of the product display area.

In another construction, the invention provides a refrigerated merchandiser including a case defining a product display area and a customer access opening. The case has an air inlet and an air outlet in communication with the product display area, and a passageway fluidly connects the air inlet with the air outlet to direct a refrigerated airflow through the air outlet across at least a portion of the customer access opening in the form of a primary air curtain. The merchandiser also includes a shelf that has an inlet disposed adjacent a rear of the shelf, a first outlet disposed adjacent a front of the shelf, and one or more second outlets disposed along the sides of the shelf and in fluid communication with the inlet to form a three-sided secondary air curtain discharged into the product display area to provide independent zone cooling to a particular region of the product display area.

In another construction, the invention provides a refrigerated merchandiser including a case defining a product display area and a customer access opening. The case has an air inlet and an air outlet in communication with the product display area, and a passageway fluidly connects the air inlet with the air outlet to direct a refrigerated airflow through the air outlet across at least a portion of the customer access opening in the form of a primary air curtain. The merchandiser also includes a shelf coupled to the case within the product display area to support product and to receive a portion of the airflow from the passageway. The shelf has a fan unit to draw air from the passageway into the shelf and a heat exchanger positioned to condition the airflow prior to the airflow being discharged from the shelf in the form of a three-sided secondary air curtain to provide an independent cooling zone within the product display area.

Other aspects of the invention will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

DETAILED DESCRIPTION

Figure 1:
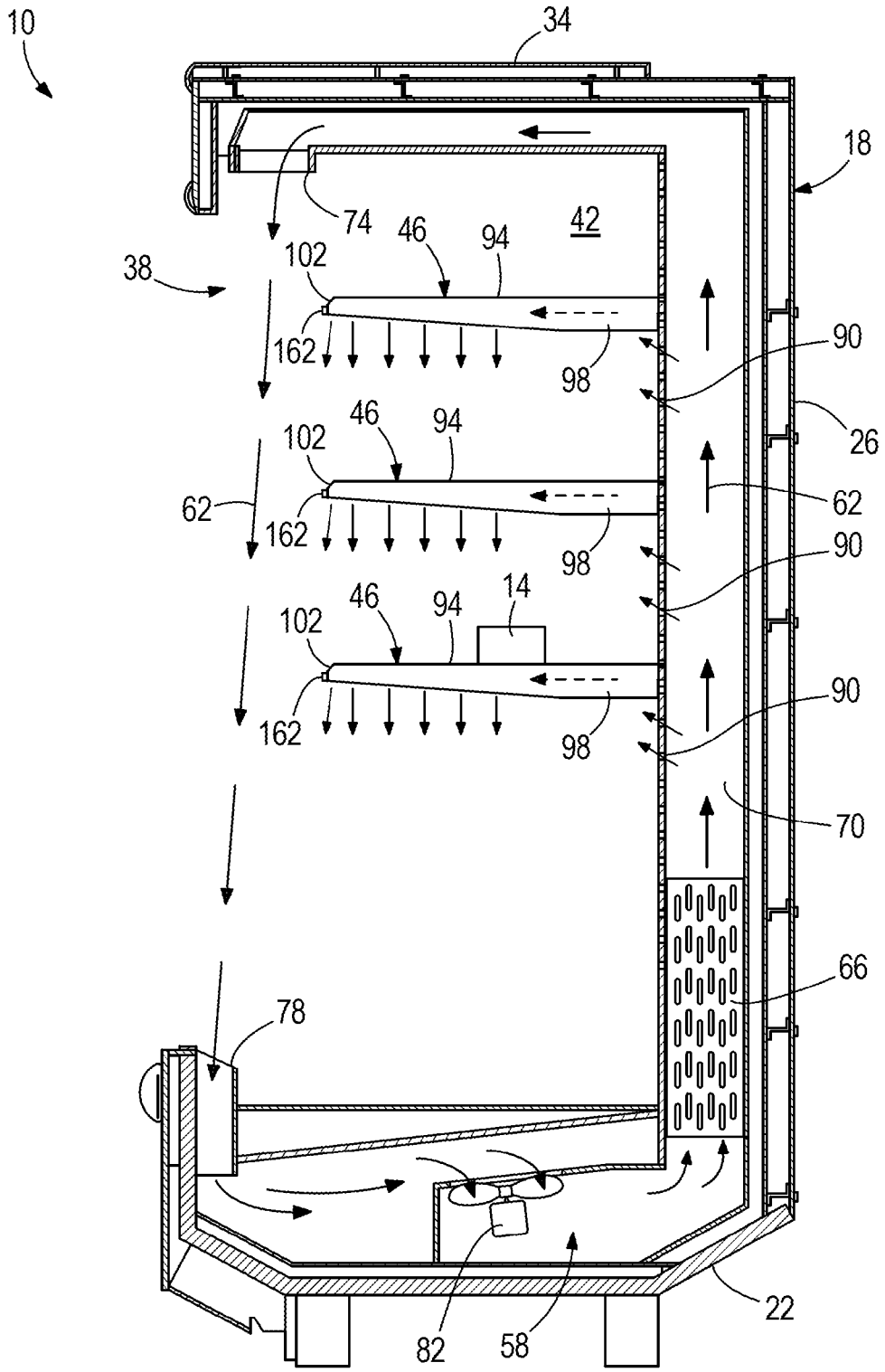
FIG. 1 is a schematic cross-section view of a refrigerated merchandiser embodying the present invention and illustrating a plurality of shelves and associated cooling zones.

FIG. 1 shows a refrigerated merchandiser 10 that may be located in a supermarket or a convenience store (not shown) for presenting fresh food, beverages, and other food product 14 to consumers. The merchandiser 10 includes a case 18 that has a base 22, a rear wall 26, side walls (not shown), a canopy 34, and a customer access opening 38. The area partially enclosed by the base 22, rear wall 26, side walls, and the canopy 34 defines a product display area 42 that supports the food product 14 in the case 18. The food product 14 is displayed on racks or shelves 46 extending forwardly from the rear wall 26, and is accessible by consumers through the customer access opening 38.

In the illustrated construction, the refrigerated merchandiser 10 is an open-front merchandiser. In other constructions the refrigerated merchandiser 10 includes one or more doors separated by mullions that define openings in communication with the product display area 42 and are horizontally spaced along the case 18 to provide structural support for the case 18.

With continued reference to FIG. 1, at least a portion of a refrigeration system 58 is in communication with the case 18 to provide a refrigerated airflow (denoted by arrows 62) to the product display area 42. The refrigeration system 58 includes an evaporator 66 disposed in an air passageway 70 of the case 18, a compressor (not shown), and a condenser (not shown) connected in series with each other. As is known in the art, the evaporator 66 receives a saturated refrigerant that has passed through an expansion valve from the condenser. The saturated refrigerant is evaporated as it passes through the evaporator 66 as a result of absorbing heat from air passing over the evaporator. The absorption of heat by the refrigerant allows the temperature of the air to decrease as it passes over the evaporator 66. The heated or gaseous refrigerant then exits the evaporator 66 and is pumped back to the compressor for re-processing into the refrigeration system 58. The cooled airflow 62 exiting the evaporator 66 via heat exchange with the liquid refrigerant is directed through the air passageway 70 and is introduced into the product display area 42 as an air curtain that maintains the food product 14 at desired conditions.

The airflow 62 is directed downward through the product display area 42 out of an air outlet 74 toward the base 22, where at least some of the airflow 62 passes through an air inlet 78. As illustrated in FIG. 1, the airflow 62 flowing through the air inlet 78 is drawn into the air passageway 70 by a fan 82 located upstream of the evaporator 66. The air inlet 78 and the air outlet 74 are both located adjacent the product display area 42.

With continued reference to FIG. 1, the rear wall 26 includes an inner panel 86 that has one or more openings 90 in communication with the air passageway 70. The openings 90 permit at least a portion of the airflow 62 to exit the air passageway 70 and to enter the product display area 42 along a rear portion of the refrigerated merchandiser 10. In some constructions the openings 90 are a matrix of circular openings along the inner panel 86. In other constructions the openings 90 are elongate rectangular openings along the inner panel 86. Various other shapes, sizes, and configurations for the openings 90 are also possible.

Figure 2:
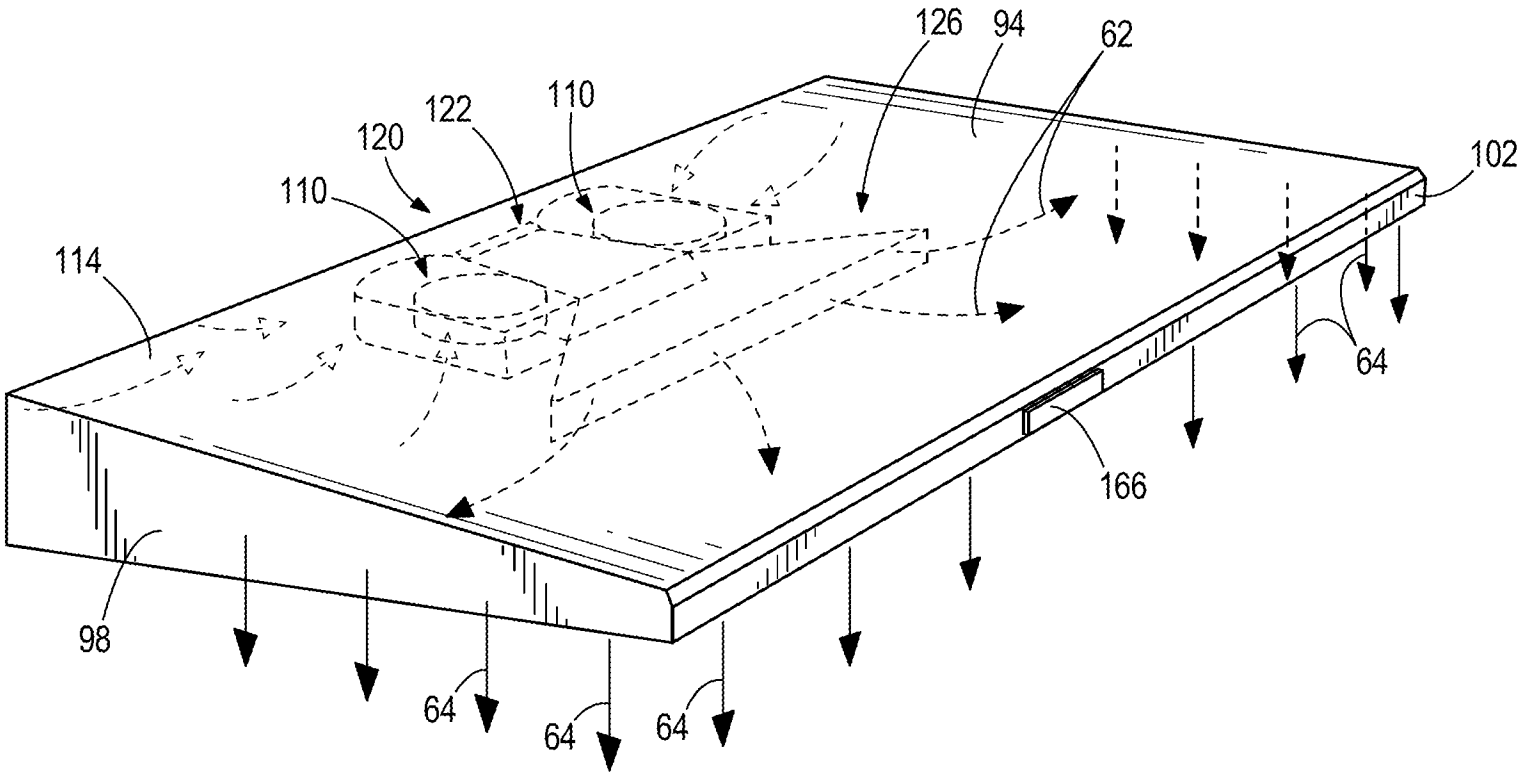
FIG. 2 is a schematic perspective view of one of the shelves of FIG. 1.
Figure 3:
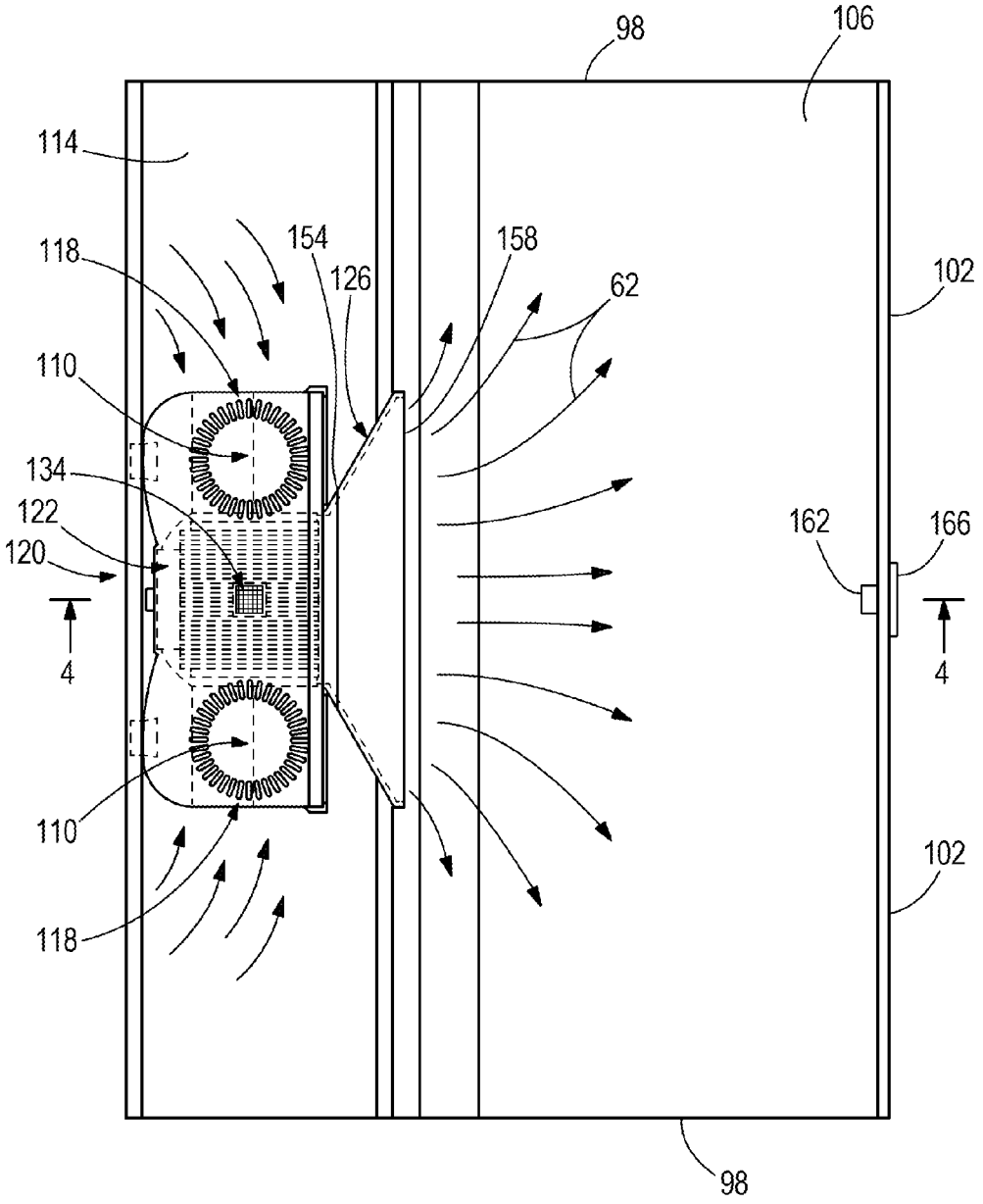
FIG. 3 is a schematic bottom view of the shelf of FIG. 2.

With reference to FIGS. 2 and 3, each of the shelves 46 is coupled to the inner panel 86 and includes a top wall 94, two side walls 98, and a front wall 102 that together define an interior area 106 inside the shelf 46. The two side walls 98 and the front wall 102 extend substantially perpendicular to the top wall 94, and the two side walls 98 extend substantially parallel to one another. The top wall 94 extends generally perpendicular to the inner panel 86.

With reference to FIG. 3, each of the shelves 46 further includes two fan units 110 disposed along a rear portion 114 of the shelf 46 inside the interior area 106. The fan units 110 are powered by an electrical power source (not shown). Each of the fan units 110 includes an air inlet 118. As illustrated by the arrows in FIGS. 1-5, the fan units 110 draw the airflow 62 that has passed through the openings 90 in the inner panel 86 into the air inlets 118 and into the interior area 106 of the shelf 46. In some constructions the fan units 110 draw the airflow 62 directly from the air passageway 70 into the interior area 106 of the shelf 46, such that the airflow 62 does not first enter the product display area 42 before entering the shelf 46.

With reference to FIGS. 2-5, after entering the air inlets 118 and passing through the fan units 110, the airflow 62 is directed along a pathway between the two fan units 110 and through a heat exchange assembly 120. The heat exchange assembly 120 includes a heat exchanger unit 122 that cools the airflow 62, and an air diffuser 126 that diffuses the cooled air.

Figure 4:
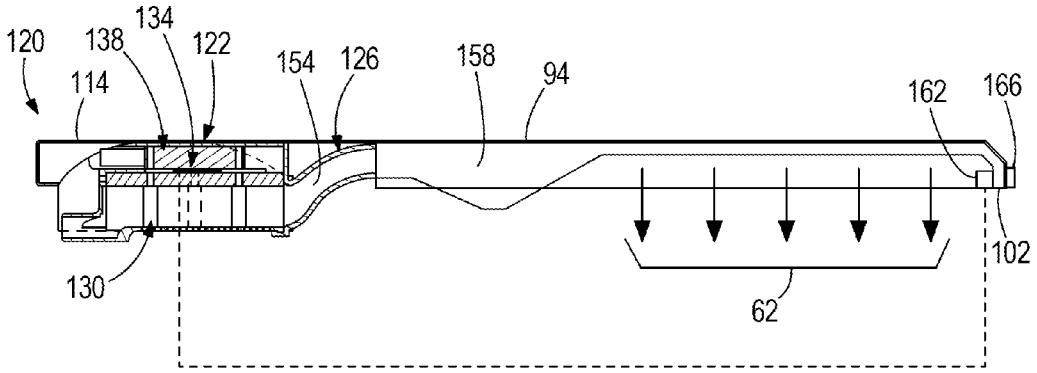
FIG. 4 is a schematic cross-sectional view of the shelf of FIG. 2, taken along lines 4-4 in FIG. 3.
Figure 5:
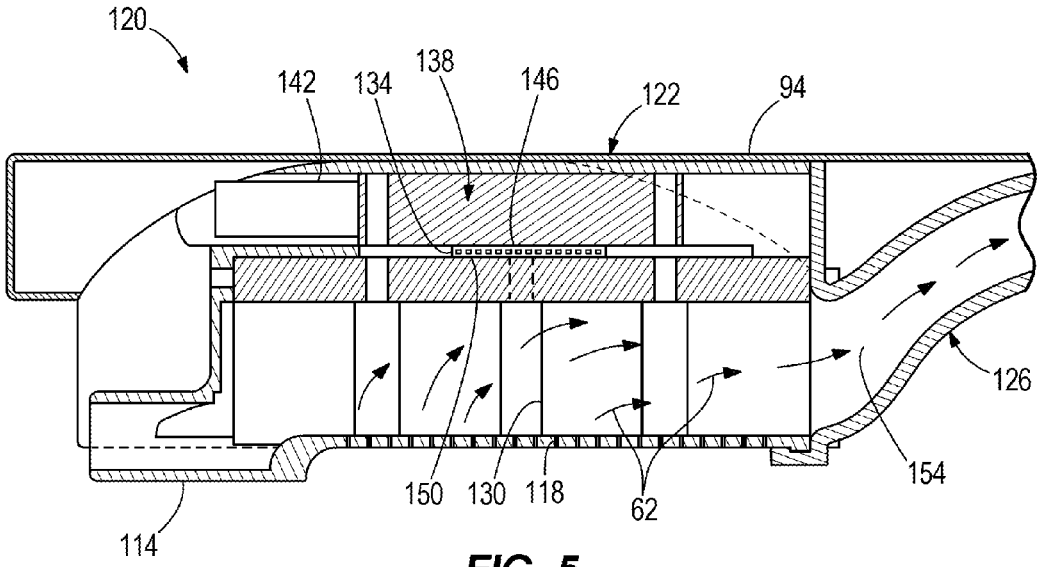
FIG. 5 is an enlarged partial view of the cross-sectional view of FIG. 4.

As illustrated in FIGS. 4 and 5, the heat exchanger unit 122 includes a first heat exchanger 130, a second heat exchanger 134 disposed adjacent the first heat exchanger, and a third heat exchanger 138 disposed adjacent the second heat exchanger 134, such that the second heat exchanger 134 is disposed between the first and third heat exchangers 130, 138. The first heat exchanger 130 includes one or more cooling fins, the second heat exchanger 134 includes one or more thermoelectric coolers, and the third heat exchanger 138 includes one or more plate heat exchangers. An inlet/outlet 142 for exchange of secondary refrigerant is coupled to the third heat exchanger 138.

With continued reference to FIG. 4, the thermoelectric cooler generates a hot side 146 and a cold side 150 when operating, the cold side 150 being disposed adjacent to and in contact with the cooling fins of the first heat exchanger 130 to keep the cooling fins cool. As the airflow 62 is directed out of the fan units 110, the airflow 62 passes over the cooling fins of the first heat exchanger 130 and is cooled by the cooling fins.

The heat generated by the hot side 146 is removed with the third heat exchanger 138. In particular, a volume of secondary, saturated refrigerant is directed into the plate heat exchanger through the inlet/outlet 142, whereby the secondary refrigerant absorbs at least a portion of the heat generated by the hot side 146. The refrigerant is evaporated as it passes through the plate heat exchanger as a result of absorbing the heat. The heated or gaseous refrigerant is then pumped through a refrigeration system (e.g., refrigeration system 58) via conduits (not shown) disposed along the back of the merchandiser 10.

With continued reference to FIGS. 2-5, after the air has passed through the heat exchanger unit 122, the air enters the air diffuser 126. The air diffuser 126 has a narrowed portion 154 disposed adjacent to the heat exchanger unit 122 and a widened portion 158 disposed away from the heat exchanger unit 122. As illustrated in FIG. 4, the widened portion 158 is disposed adjacent the top wall 94. The air diffuser 122 directs and disperses the cooled airflow 62 toward the front wall 102, as well as toward the two side walls 98. Other constructions include various other shapes, sizes, and configurations for the air diffuser 126. In some constructions, no air diffuser 126 is used inside the shelf 46.

With reference to FIGS. 1-4, the side walls 98 and the front wall 102 cooperatively direct the discharged airflow 62 in a generally downward direction, generally perpendicular to the top wall 94. The discharged airflow 62 forms a uniform air curtain 64 (illustrated in FIG. 2) beneath the shelf 46 that defines a three-dimensional cooling zone directly beneath the shelf 46. This cooling zone is used to cool food product 14 located directly beneath the shelf 46. Depending on the desired level of cooling, each cooling zone may have a different temperature.

In some constructions the shelf 46 further includes a bottom wall, or one or more additional interior walls, that direct the airflow 62 within the shelf 46. In some constructions the shelf 46 includes a plurality of openings or channels disposed within or adjacent the front wall 102 and side walls 98 that direct the cooled airflow 62 out of the shelf 46 and form various air curtains beneath the shelf 46. While three air curtains are illustrated in FIG. 1, in other constructions more or less than three air curtains are used.

The cooling zones generated within the boundaries of the air curtains exiting the shelves 46 have temperatures different than the surrounding air temperature in the product display area 42. In particular, the cooling zones have temperatures that vary by as much as between 5-20 degrees Fahrenheit from the surrounding temperature in the product display area 42. Other constructions have cooling zones with temperatures that vary by more or than 20 degrees Fahrenheit from the surrounding temperature in the product display area 42. In some constructions the shelves 46 are adjustable within the case 18 (e.g., may be moved up and down within the case 18), such that size of the cooling zones is altered.

With reference to FIGS. 1-5, the shelves 46 further include temperature control elements 162 (e.g., knobs) that control the level of temperature within the cooling zones. The temperature control elements 162 are coupled to the heat exchanger unit 122. In particular, and as illustrated in FIG. 4, the temperature control elements 162 are coupled to the thermoelectric cooler in the second heat exchanger 134 to vary the amount of heat transfer generated within the thermoelectric cooler and vary the cooling temperature applied to the airflow 62.

With reference to FIGS. 3 and 4, the shelves 46 further include at least one light source 166. The light source 166 is coupled to an inside of the front wall 102, although in some constructions the light source 142 is coupled to an outside of the front wall 102, or elsewhere along the shelf 46. The light source 142 provides additional lighting inside the merchandiser 10 for each of the cooling zones and its associated food product 14.

Various features and advantages of the invention are set forth in the following claims.

The invention claimed is:

1. A refrigerated merchandiser comprising:

a case defining a product display area and a customer access opening, the case including an air inlet and an air outlet in communication with the product display area;

a passageway fluidly connecting the air inlet with the air outlet to direct a refrigerated airflow through the air outlet across at least a portion of the customer access opening in the form of an air curtain; and a plurality of shelves coupled to the case within the product display area to support product, each shelf including:

an inlet disposed adjacent a rear of the shelf;

an outlet disposed adjacent a front of the shelf;

a fan unit disposed in the shelf and in communication with the passageway to draw air from the passageway through the inlet from directly below the shelf to direct a portion of the airflow through the shelf toward the outlet; and a heat exchanger disposed in the shelf to cool the airflow in the shelf to provide independent zone cooling to a predetermined region of the product display area, wherein the air drawn into the shelf by the fan unit is drawn from the product display area directly below the shelf.

2. The refrigerated merchandiser of claim 1, wherein the fan unit includes two or more fans, and the heat exchanger is disposed between the fans.

3. The refrigerated merchandiser of claim 1, wherein the heat exchanger includes a thermoelectric cooler.

4. The refrigerated merchandiser of claim 3, wherein the heat exchanger includes a plurality of fins, and wherein the thermoelectric cooler is disposed adjacent and in contact with the plurality of fins.

5. The refrigerated merchandiser of claim 1, wherein the heat exchanger includes a plate heat exchanger adapted to receive a refrigerant.

6. The refrigerated merchandiser of claim 1, wherein each shelf includes a front wall and two side walls that cooperate to direct the cooled airflow generally downward from the associated shelf in the form of a three-dimensional air curtain having airflows only along the front wall and along one or both of the side walls.

7. The refrigerated merchandiser of claim 1, wherein each shelf further includes an adjustable temperature control element.

8. The refrigerated merchandiser of claim 1, further comprising a canopy disposed substantially above the product display area, wherein the canopy includes the air outlet.

9. A refrigerated merchandiser comprising:

a case defining a product display area and a customer access opening, the case including an air inlet and an air outlet in communication with the product display area;

a passageway fluidly connecting the air inlet with the air outlet to direct a refrigerated airflow through the air outlet across at least a portion of the customer access opening in the form of a primary air curtain; and a shelf including one or more fans, an inlet disposed adjacent a rear of the shelf, a first outlet disposed adjacent a front of the shelf, and one or more second outlets disposed along the sides of the shelf and in fluid communication with the inlet to form a three-sided secondary air curtain directed downward from the first outlet and the second outlets only along a perimeter of the shelf into the product display area to provide independent zone cooling to a particular region of the product display area, wherein the air drawn into the shelf by the one or more fans is drawn from the product display area directly below the shelf.

10. The refrigerated merchandiser of claim 9, wherein the shelf includes two fans positioned to direct air toward the outlets, and a heat exchanger disposed between the two fans.

11. The refrigerated merchandiser of claim 10, wherein one of the fans is disposed adjacent the inlet.

12. The refrigerated merchandiser of claim 10, wherein the heat exchanger includes a thermoelectric cooler.

13. The refrigerated merchandiser of claim 12, wherein the thermoelectric cooler is disposed adjacent and in contact with a plurality of fins of the heat exchanger.

14. The refrigerated merchandiser of claim 9, wherein the shelf further includes an adjustable temperature control element.

15. The refrigerated merchandiser of claim 1, wherein the airflow is discharged from the shelf in the form of a three-sided secondary air curtain to provide an independent cooling zone within the product display area.

16. The refrigerated merchandiser of claim 15, wherein the heat exchanger includes fins and a thermoelectric cooler.

17. The refrigerated merchandiser of claim 16, wherein the thermoelectric cooler is disposed adjacent and in contact with the fins.

18. The refrigerated merchandiser of claim 16, wherein the fins are disposed on an underside of the shelf.

* * * * *